US007556252B2

(12) United States Patent
Terao et al.

(10) Patent No.: US 7,556,252 B2
(45) Date of Patent: Jul. 7, 2009

(54) SHEET POST-PROCESSING APPARATUS

(75) Inventors: Yasunobu Terao, Izunokuni (JP); Hajime Yamamoto, Mishima (JP); Yoshiaki Sugizaki, Sunto-gun (JP); Takahiro Kawaguchi, Mishima (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 434 days.

(21) Appl. No.: 11/533,403

(22) Filed: Sep. 20, 2006

(65) Prior Publication Data

US 2007/0063410 A1 Mar. 22, 2007

(30) Foreign Application Priority Data

Sep. 21, 2005 (JP) ..... 2005-274282

(51) Int. Cl.
*B65H 37/04* (2006.01)

(52) U.S. Cl. ..... 270/58.12; 270/58.07; 270/58.08; 270/58.09; 270/58.11; 270/58.27

(58) Field of Classification Search ..... 270/58.01, 270/58.07, 58.08, 58.09, 58.11, 58.12, 58.17, 270/58.27; 399/407, 410
See application file for complete search history.

(56) References Cited

U.S. PATENT DOCUMENTS 5,290,020 A * 3/1994 Matsui et al. ..... 270/58.19
5,662,318 A * 9/1997 Harada et al. ..... 270/58.05
6,145,825 A * 11/2000 Kunihiro et al. ..... 270/58.09
6,209,864 B1 * 4/2001 Taniguchi et al. ..... 271/220
6,330,999 B2 * 12/2001 Coombs et al. ..... 270/58.18
2006/0220293 A1 * 10/2006 Kaneko ..... 270/58.08

FOREIGN PATENT DOCUMENTS

JP 08-099754 4/1996
JP 2906046 4/1999

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet post-processing apparatus includes a processing tray and a stapler. The processing tray has a mounting area, a flexible portion, and an edge holding part. A sheaf of sheets is made on the processing tray. A sheet P to be stapled is stacked on the mounting area. The flexible portion is formed integrally with the mounting area and at the same level as the upper surface of the mounting area, along the edge of the mounting area of the side to staple the sheaf of sheets, and is bent easier than the mounting area in the direction of the thickness of the sheaf of sheets toward the mounting area. The stapler has a fixed part and an arm, and staples a sheaf of sheets. The fixed part is provided deviated from the upper surface of the mounting area to the mounting unit.

6 Claims, 13 Drawing Sheets

SHEET POST-PROCESSING APPARATUS

CROSS-REFERENCE TO RELATED APPLICATIONS

This application is based upon and claims the benefit of priority from prior Japanese Patent Application No. 2005-274282, field Sep. 21, 2005, the entire contents of which are incorporated herein by reference.

BACKGROUND OF THE INVENTION

1. Field of the Invention

The present invention relates to a sheet post-processing apparatus, which takes in sheets, binds the sheets into a sheaf, and staples the sheaf of sheets.

2. Description of the Related Art

There is a conventional sheet post-processing apparatus, which takes in a sheet printed and ejected from a multi function peripheral (MFP), and performs post-processing based on the information output from the MFP. The sheet post-processing apparatus described in Japanese Patent No. 2906046 aligns sheaves of sheets supplied to a processing tray, and staples the sheaves of sheets at two positions at the edge of the side of each sheaf. When the sheet post-processing apparatus staples a sheaf at a first position and then at a second position, the sheet post-processing apparatus holds the area of the sheaf between the first and second stapling positions by a pressing means, thereby preventing swelling of the sheaf at two stapling positions.

A stapler incorporated in the sheet post-processing apparatus has a sheaf inserting port which has a gap for clipping the sheaf larger than the thickness of the sheaf. When a sheaf of sheets is stapled, a sheaf is inserted into the port leaving a clearance for a staple. The stapler has a magazine loaded with staples, and an anvil to bend and shape the point of a staple that has pierced a sheaf of sheets.

Generally, one of the magazine and anvil is held, and the other is rotationally moved with respect to the fixed one. A sheaf of sheets is clamped, and a staple loaded in the magazine is shot. The anvil bends back and shapes the point of the pierced staple. A sheaf of sheets is held in the insertion port leaving a clearance either side of the port. Therefore, as one of the magazine or anvil is fixed, a sheaf of sheets is bent toward the fixed part when the sheaf is clamped. Considering that the number of sheaves varies randomly, a processing tray, on which sheets are stacked, is often used as a fixed and supported side.

Therefore, when a stapler clamps a sheaf of sheets, the sheaf is pressed to the fixed part of the processing tray side by the movable part, and is bent along the edge of the processing tray. An air layer is formed among sheets, and if the number of sheets to be bound into one sheaf is large, a sheet may be displaced during stapling, and may not be normally pierced by a staple of the stapler.

To solve the above problem, the edge of the processing tray is distant from the stapler, so that the whole sheaf of sheets can easily be bent to meet the movement of the stapler. A clearance from the processing tray to the stapler is filled by sticking a separately prepared film-like member.

However, the film-like member must be manually attached to the processing tray, therefore the manufacturing cost of the post-sheet processing apparatus is increased. Further, even if the film-like member is stuck well, a sheet warps a little after printing, and may run into the clearance between the film member and the processing tray, causing a jam.

BRIEF SUMMARY OF THE INVENTION

A sheet post-processing apparatus according to the present invention takes in a sheet sent from an MFP. The sheet post-processing apparatus has a processing tray and a stapler. Based on instruction signals output from the MFP, the sheet post-processing apparatus makes a sheaf of sheets on the processing tray if necessary. The sheet post-processing apparatus staples a sheaf of sheets by the stapler. The processing tray of the sheet post-processing apparatus has a mounting area, a flexible portion, and an edge holding part. A sheet provided for stapling is stacked on the mounting area. The flexible portion is formed integrally with the mounting area and at the same level as the upper surface of the mounting area, along the edge of the mounting area of the side to staple a sheaf of sheets, and is bent easier than the mounting area in the direction of the thickness of the sheaf of sheets toward the mounting area. The stapler is provided at a position to clamp the edge of a sheaf of sheets stacked on the mounting area. The edge holding part extends to the stapler further than the flexible part, and supports the edge of the sheets stacked on the mounting area. The stapler has a fixed part and an arm. The fixed part is provided at a position deviated from the upper surface of the mounting area to an opposite side of the mounting area, and closer to the mounting area than the edge holding part. The arm is provided at the position to hold the edge of a sheaf of sheets toward the fixed part, and is rotationally moved in the sheet stacking direction.

Objects and advantages of the invention will be set forth in the description which follows, and in part will be obvious from the description, or may be learned by practice of the invention.

BRIEF DESCRIPTION OF THE SEVERAL VIEWS OF THE DRAWING

The accompanying drawings illustrate presently preferred embodiments of the invention, and together with the general description given above and the detailed description of the embodiments given below, serve to explain the principles of the invention.

DETAILED DESCRIPTION OF THE INVENTION

Figure 1:
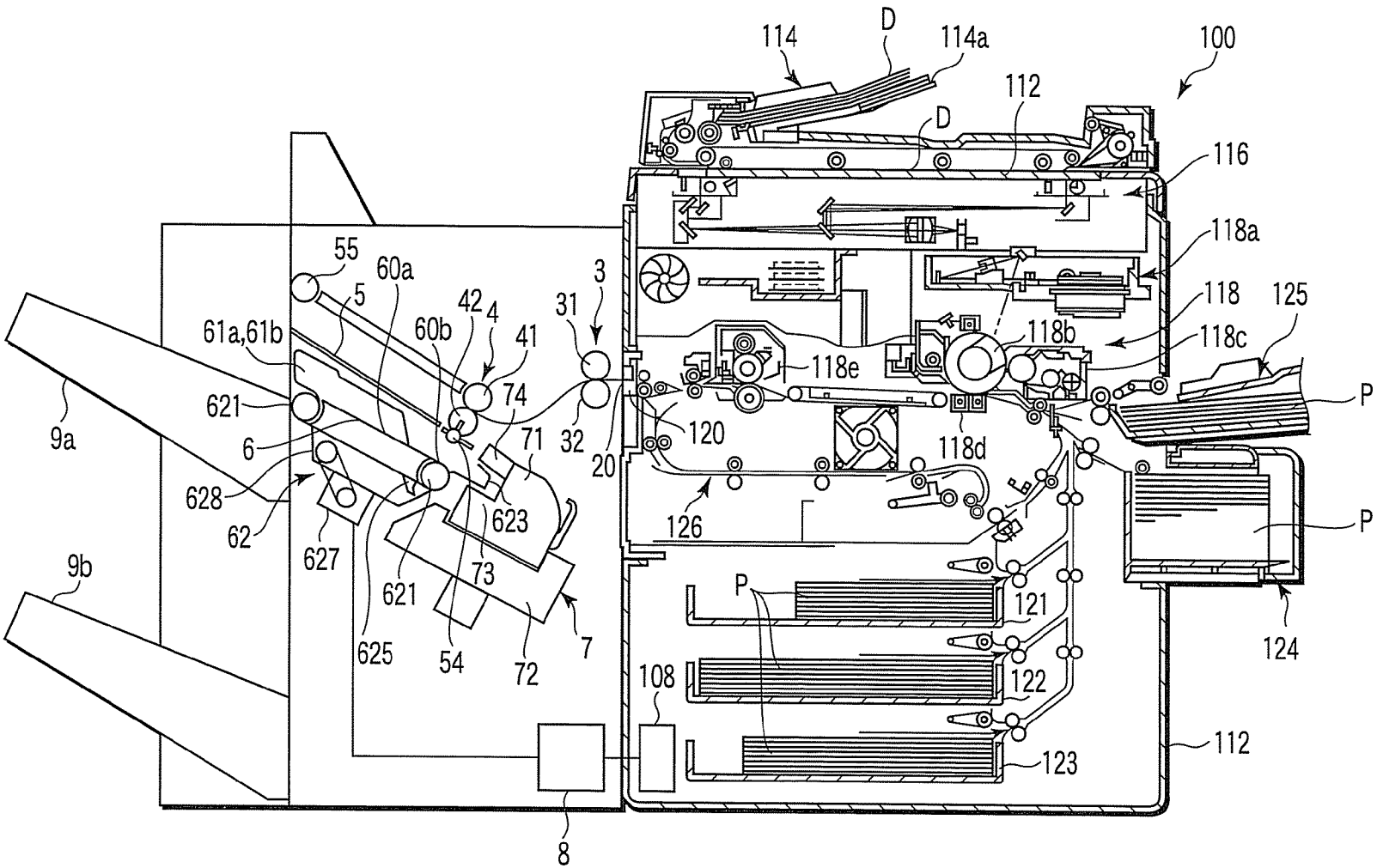
FIG. 1 is a schematic diagram showing a sheet post-processing apparatus according to an embodiment of the invention, and MFP.

A sheet processing apparatus according to an embodiment of the invention will be explained hereinafter with reference to FIG. 1 to FIG. 13. A sheet processing apparatus shown in FIG. 1 is connected to the downstream side of the sheet flowing direction of MFP (Multi Function Peripheral) 100. An explanation will be given first to the configuration of the MFP 100 as a sheet pre-processing apparatus, with reference to FIG. 1.

The MFP 100 shown in FIG. 1 has a housing 112, a document mounting table 112*a*, an automatic document feeder 114, a scanner 116, an image forming unit 118, sheet cassettes 121 and 122, and a manual-feed tray 125. The MFP 100 of FIG. 1 has also a large-capacity feeder 124 containing a number of same-size sheets P in the upstream side of the sheet P flowing direction.

The housing forms an outer case of MFP 100, and has an operation panel at the top faced to the user. The operation panel has a start button and an input means capable of setting various editing functions. The editing functions include selecting a sheet size, specifying stapling, specifying a stapling position, setting the number of copies/printing magnification/scanning resolution, and specifying a double-sided print. The document mounting table 112*a* is a transparent glass plate provided on the upper surface of the housing 112.

The automatic document feeder 114 is provided on the document mounting table 112*a*, and raised upward through a hinge provided in the back viewed from the user. The automatic document feeder 114 has a document supply tray 114*a*. When the start button of the operation panel is pressed, the automatic document feeder 114 automatically conveys a document D set on the document supply tray 114*a* over the document mounting table 112*a*.

Concretely, the user first sets the document D on the document supply tray 114*a* of the automatic document feeder 114. Then, the user enters editing conditions from the operation panel, and presses the start button. The documents D of the document supply tray 114*a* are automatically conveyed one by one to a reading position provided on the document mounting table 112*a*. The document D is automatically ejected at an appropriate timing to read image data.

The scanner 116, image forming unit 118, sheet cassettes 121, 122 and 123 are provided inside the housing 112. The scanner 116 is incorporated right under the document mounting table 112*a*. The scanner 116 applies a beam from a light source to the document D positioned on the document mounting table 112*a* by the automatic document feeder 114. The scanner 116 contains a photoelectric converter to read a reflected beam of the applied beam, and creates image data of the document D.

The image forming unit 118 is provided at the middle of the housing 112 and under the scanner 16. The image forming unit 118 has a laser unit 118*a*, a photoconductive drum 118*b*, a developing unit 118*c*, a transfer unit 118*d*, and a fixing unit 118*e*. The laser unit 118*a* applies a beam to the outer surface of the photoconductive drum 118*b*, based on the image data read by the scanner 116.

Receiving the laser beam from the laser unit, an electrostatic latent image is formed on the outer surface of the photoconductive drum 118*b*. The developing unit 118*c* supplies toner to the outer surface of the photoconductive drum 118*b*, and visualizes the electrostatic latent image as a real image. The transfer unit 118*d* electrostatically transfers the real toner image to the conveyed sheet P. The fixing unit 118*e* heats and presses the sheet P by a heated roller, and fuses and fixes the toner transferred on the sheet P.

The MFP 100 also has a reverse conveying path 126 connected from the downstream side of the fixing unit 118*e* to the upstream side of the transfer unit 118*d*. The reverse conveying path 126 has a function to turn over the sheet P. When a double-sided print is set, the sheet P is turned over through the reverse conveying path 126 and returned to the upstream side of the transfer unit 118*d*, after once passing through between the photoconductive drum 118*b* and transfer unit 118*d*, and is sent to the fixing unit 118*e*.

The sheet cassettes 121, 122 and 123 are provided in the lower part of the housing 112, and hold a sheet P to be supplied to the image forming unit 118. Each sheet cassette 121, 122 and 123 desirably holds a different-size sheet P. Any one of the sheet cassettes 121, 122 and 123 supplies the image forming unit 118 with a sheet P of any one of the sizes corresponding to the size selected by the operation panel, the size measured when the automatic document feeder 114 reads the document D, or the size measured when the scanner 116 reads the image data.

When the sheet P set in the manual-feed tray 125 is selected by the operation panel, the sheet P is supplied from the manual-feed tray 125. When a large number of printing copies is selected by the operation panel, or when it is previously known that a predetermined size sheet P is mainly consumed, the sheet P of the size stocked in the large-capacity feeder 124 is supplied.

The sheet P printed as a pre-processing in the MFP is supplied through the ejection slit 120. The sheet post-processing apparatus 1 is connected to the MFP 100, so that the take-in port is adjoined to the ejection slit 120. The sheet post-processing apparatus 1 is incorporated with a stapler 7 as a processing unit. The sheet post-processing apparatus 1 takes in the sheet P printed in the MFP 100, and binds sheets P into a sheaf of sheets S if necessary based on the editing condition set in the MFP 100. The sheet post-processing apparatus 1 performs a post-processing for the sheaf of sheets S, and sends them to paper eject trays 9*a* and 9*b*. The sheet post-processing apparatus 1 will be explained hereinafter.

The sheet post-processing apparatus 1 has a frame 2, an inlet roller 3, a supply roller 4, a standby tray 5, a processing tray 6, a stapler 7, a controller 8, and paper eject trays 9*a* and 9*b*. The frame 2 constitutes the outer case of the sheet post-processing apparatus 1. The frame 2 has a take-in port 20 at the position aligned with the ejection slit 120 of the MFP 100 in the state installed on the floor.

The inlet roller 3 is formed as a pair of an upper inlet roller 31 and a lower inlet roller 32, and provided in the vicinity of the take-in port 20. The sheet P taken in from the take-in port 20 by the inlet roller 3 is guided to the supply roller 4 along a conveying path G.

The supply roller 4 is formed as a pair of an upper supply roller 41 and a lower supply roller 42, and sends the sheet P to the standby tray 5. The supply roller 4 starts rotation when a sensor provided at the take-in port 20 detects that the sheet P has been taken in, and stops rotation at the timing based on that the sensor detects the sheet P has passed.

The standby tray is provided in the downstream side of the supply roller 4 in the sheet P conveying direction. The processing tray is provided under the standby tray 5. The standby tray 5 and the processing tray 6 are inclined at an angle that the supply roller 4 side is low and the paper eject trays 9*a*/9*b* side is high. The standby tray 5 temporarily stacks the sheet P taken in while the sheaf of sheets S to be processed first remains in the processing tray 6. The standby tray 5 has a left-side tab and a right-side tab, which are separated on both sides in the width direction of the supplied sheet P. When the left-side tab and right-side tab are broadened in the width direction of the sheet P, the sheet P held on the standby tray 5 drops onto the processing tray 6.

Figure 5:
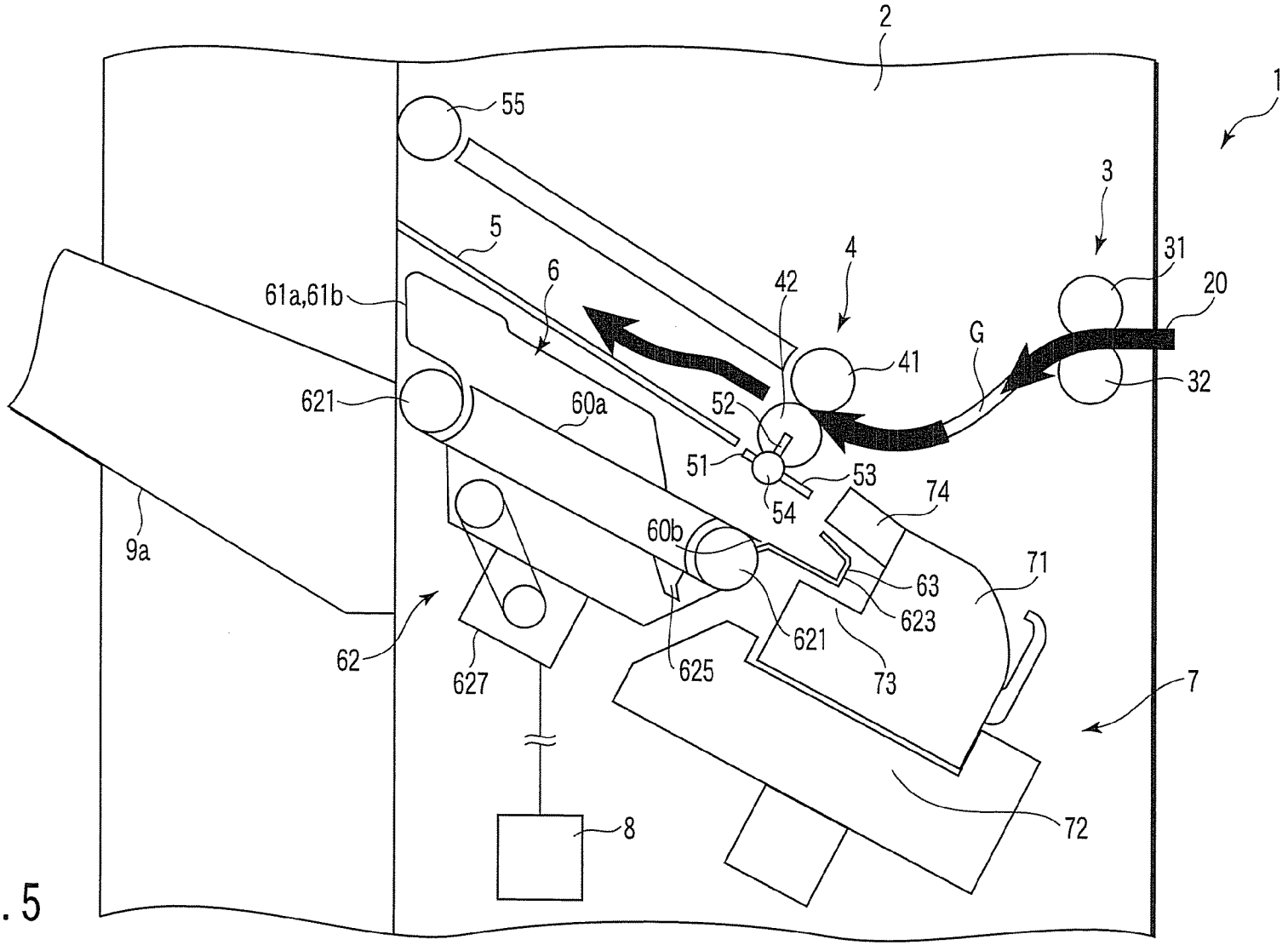
FIG. 5 is a schematic diagram showing the state that the sheet post-processing apparatus of FIG. 1 takes a first sheet of a sheaf of sheets into a standby tray.
Figure 9:
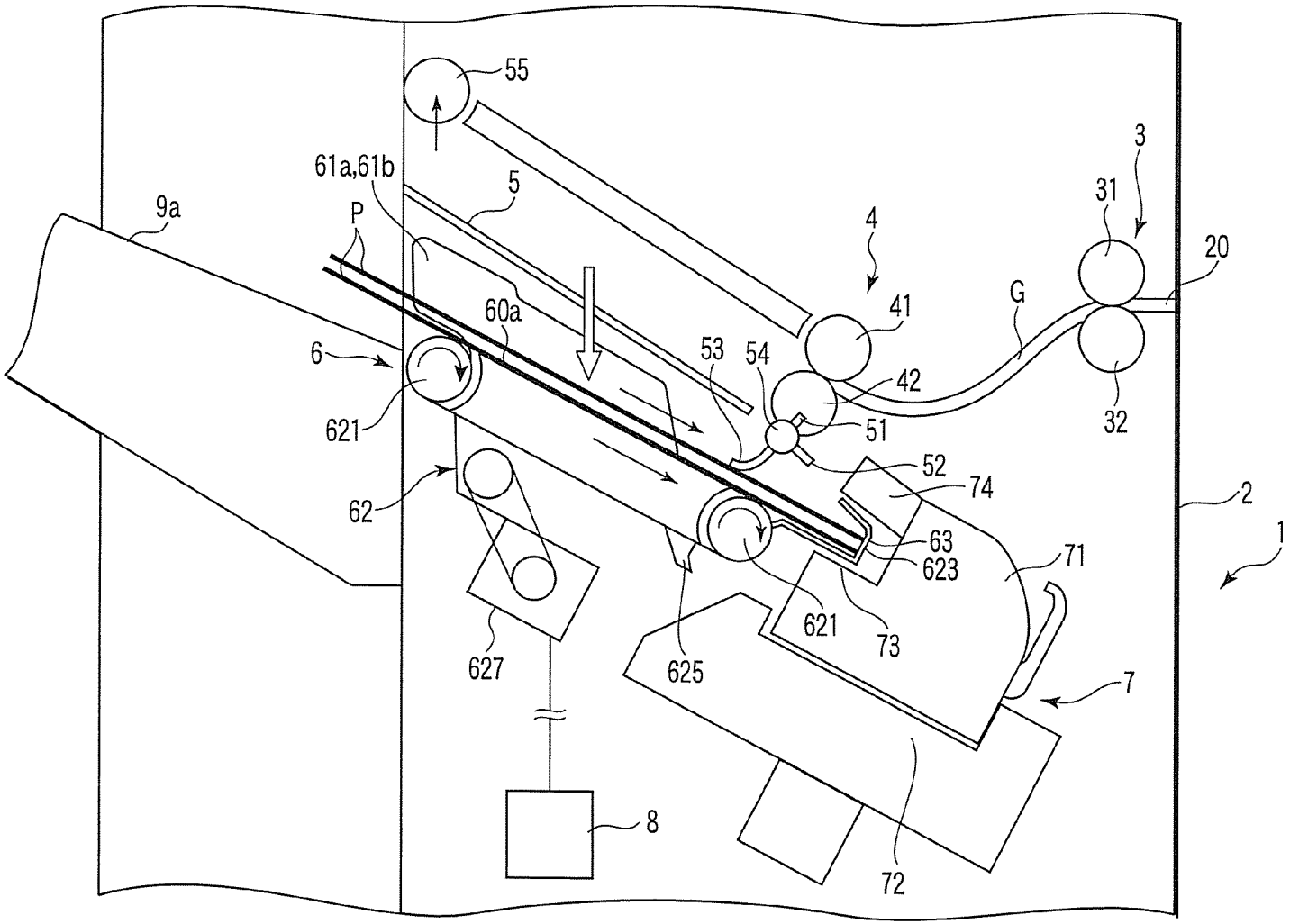
FIG. 9 is a schematic diagram showing the state that the sheet post-processing apparatus of FIG. 8 moves a sheet stacked on a standby tray to a processing tray.

A rotor 54 is provided at the end of the standby tray 5 close to the supply roller 4 as shown in FIG. 5. The rotor 54 has a receiver 51, a tap fin 52, and a paddle 53. The receiver 51, tap fin 52 and paddle 53 extend radially from the center of the rotation axis of the rotor 54. The rotor 54 holds the edge of the sheet P held on the standby tray 5 by the receiver 51. The rotor 54 rotates to drop the sheet P of the standby tray 5 onto the processing tray, and pushes up the edge of the sheet P toward the processing tray 6. By rotating further, the rotor 54 sends the uppermost sheet P of the sheet P dropped onto the processing tray 6 to the stapler 7 by using the flexible paddle 53, as shown in FIG. 9.

Figure 13:
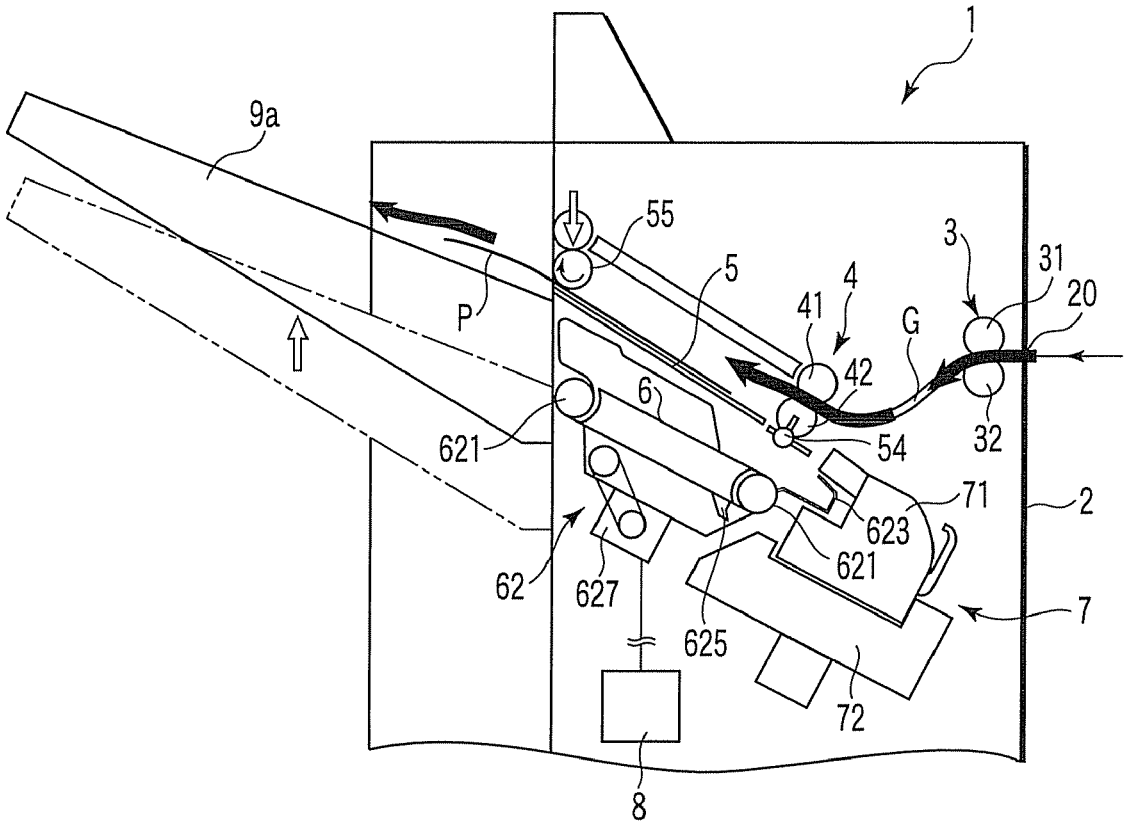
FIG. 13 is a schematic diagram showing the state that the sheet post-processing apparatus of FIG. 1 conveys a non-stapled sheet to a paper eject tray.

A standby tray roller 55 is provided on the standby tray 5 close to the paper eject trays 9*a* and 9*b*. This tray roller comes close to the standby tray 5 and rotates to send the sheet P not requiring a post-process to the paper eject trays 9*a* and 9*b*, as shown in FIG. 13.

Figure 2:
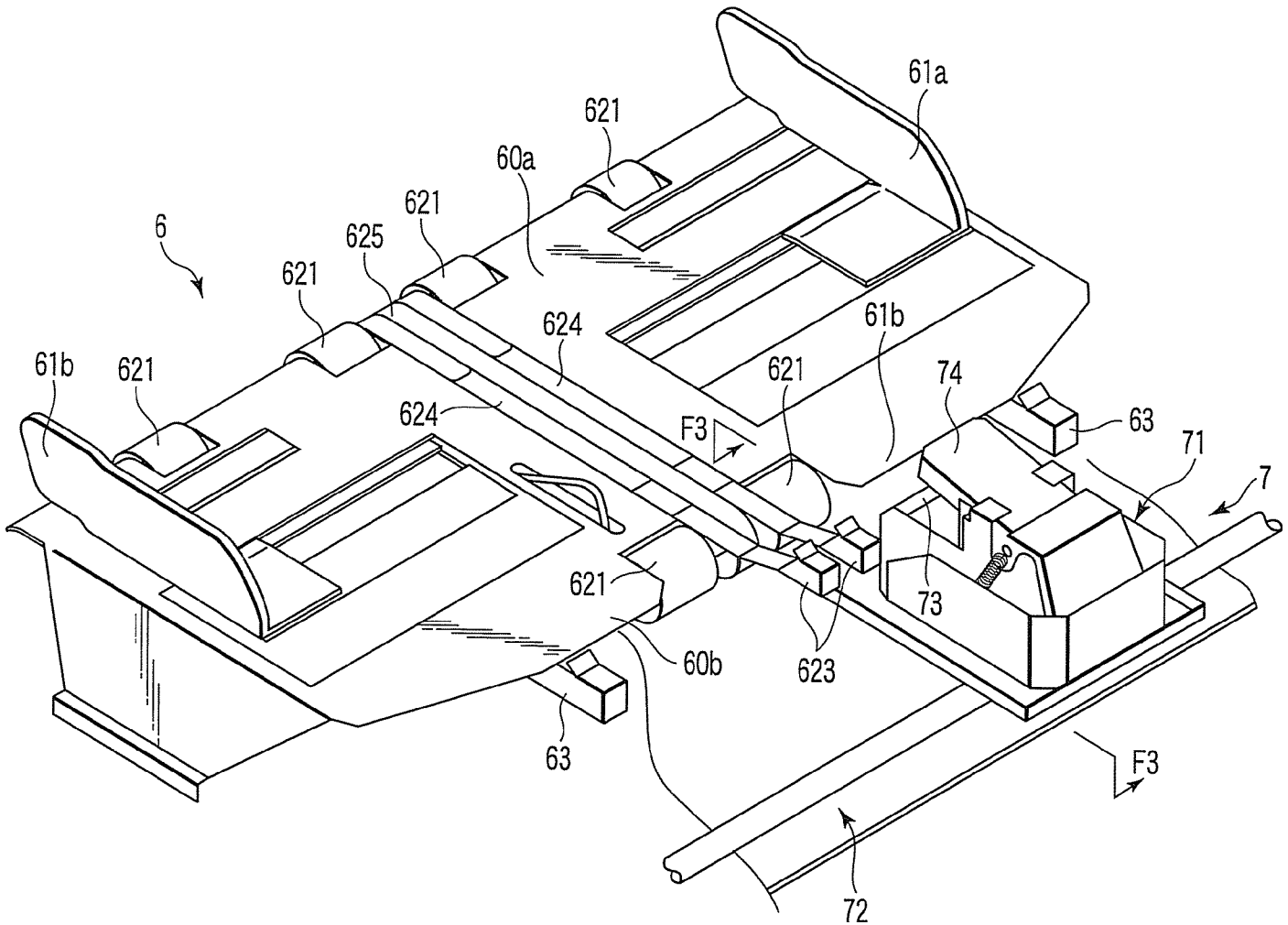
FIG. 2 is a perspective view showing a processing tray and a stapler provided in the sheet post-processing apparatus of FIG. 1.

As shown in FIG. 2, the processing tray 6 has a mounting area 60*a*, a flexible portion 60*b*, width adjustment pads 61*a* and 61*b*, a sheaf conveying mechanism 62, and an edge holding part 63. The sheet P to be stapled is stacked on the top of the mounting area 60*a*. The whole mounting area 60*a* is inclined, so that the rear side becomes to be low in the direction of ejecting the sheaf of sheets S after stapling.

Figure 3:
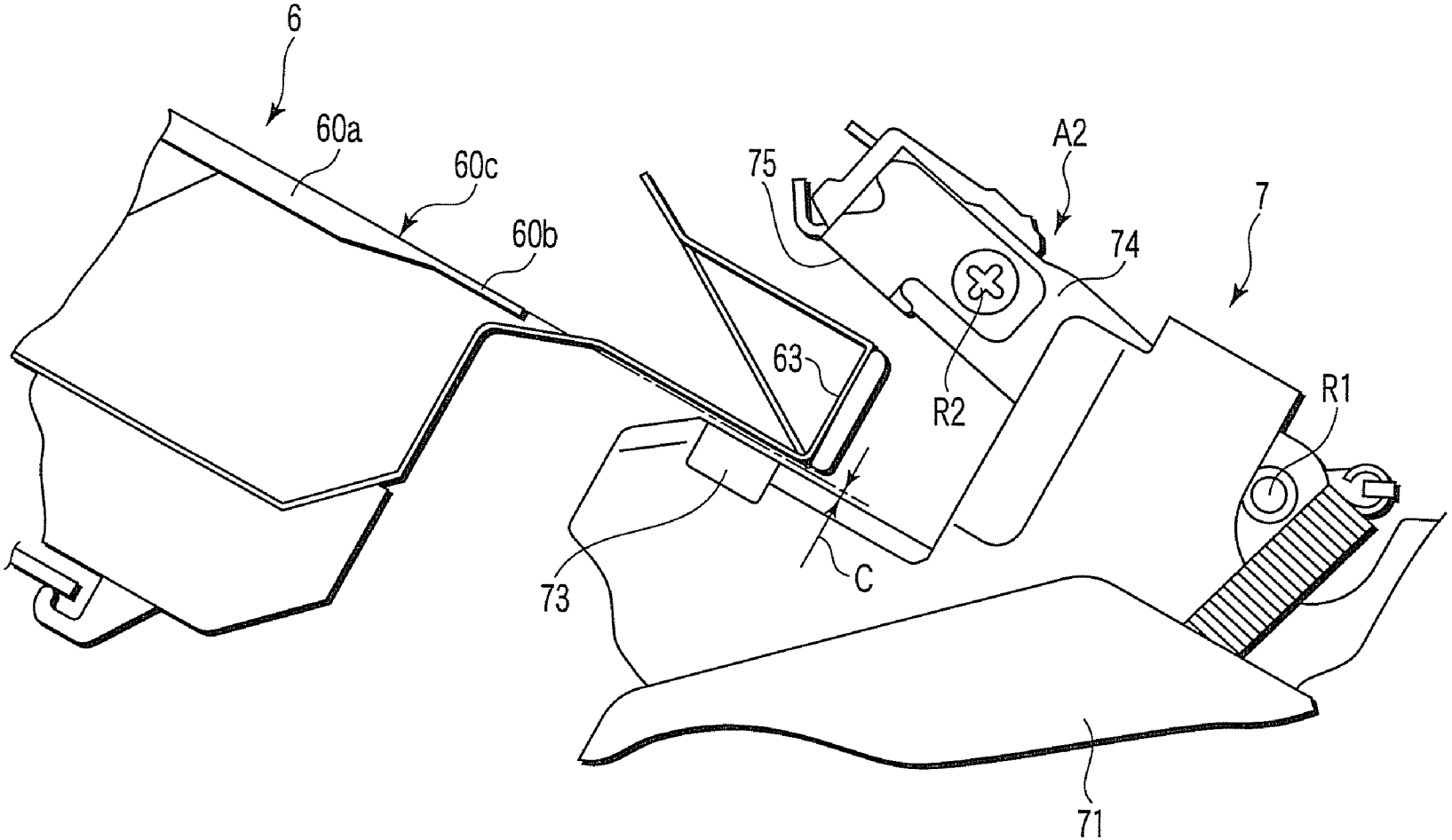
FIG. 3 is a sectional view showing the processing tray and stapler taken along lines F3-F3 of FIG. 2.

The flexible portion 60*b* is formed integrally with the mounting area 60*a*, and at the same level as the top of the mounting area 60*a*, along the edge of the mounting area 60*a* close to the side to bind the sheaf of sheets S. The flexible portion 60*b* is formed bendable to the mounting area 60*a* in the thickness direction of the sheaf of sheets S, and is more flexible than the mounting area 60*a*. Concretely, as shown in FIG. 3, the flexible portion 60*b* is made thinner than the mounting area 60*a*. It is preferable to gradually change the thickness of the boundary 60*c* between the mounting area 60*a* and the flexible portion 60*b*, to gently bend the sheaf of sheets S.

The width adjustment pads 61*a* and 61*b* are provided as a pair at the positions outside the width of the sheet P, standing upright from the top or the sheet mounting surface of the mounting area 60*a*. Whenever a sheet P is supplied, the width adjustment pads 61*a* and 61*b* are moved close to each other by a driving mechanism provided separately, thereby adjusting the displacement in the width direction of the sheet P supplied to the processing tray 6 to make the sheaf of sheets S.

The sheaf conveying mechanism 62 is provided under the sheet mounting surface. The sheaf conveying mechanism 62 has a conveying roller 621, a sheaf send-out claw 623, a send-out belt 624, a sheaf conveying claw 625, a conveying belt 626, a driving motor 627, and an interlocking mechanism 628. The conveying roller 621 is provided at the front end and rear end of the mounting area 60*a* in the direction of ejecting the stapled sheaf of sheets S, and projected a little from the mounting surface. The conveying roller 621 is rotated by a separately provided roller driving motor in one of the directions of applying the first sheet dropped from the standby tray to the edge holding part 63 on the mounting area 60*a*, and ejecting the sheaf of sheets S from the processing tray 6 to the paper eject trays 9*a* and 9*b*.

The send-out claw 623 is fixed to the send-out belt 624, and moves the sheaf of sheets S onto the mounting area 60*a* toward the paper eject trays 9*a* and 9*b*. The sheaf conveying claw 625 is fixed to the outer surface of the conveying belt 626. The sheaf conveying claw 625 is hidden under the mounting area 60*a* in the standby state, and is raised around the flexible portion 60*b*, so as to contact the edge of the sheaf of sheets S when the sheaf send-out claw 623 reaches the mounting area 60*a*.

The edge holding part 63 is projected to the stapler 7 farther than the flexible portion 60*b* of the processing tray 6, as shown in FIG. 2 and FIG. 3. The edge holding part 63 supports the edge of the sheet P stacked on the mounting area 60*a* of the processing tray 6, by cooperating with the sheaf send-out claw 623 of the sheaf conveying mechanism 62.

The stapler 7 has a head 71 and a positioning rail 72. The head 71 has a fixed part 73, an arm 74, and an anvil 75. The positioning rail 72 projects from the flexible portion 60*b*, and moves the head 71 along the edge of the sheaf of sheets S supported by the edge holding part 63. The stapler 7 can change the direction of the head 71 inward by about 45 degrees at a corner of the sheaf of sheets S.

Figure 4:
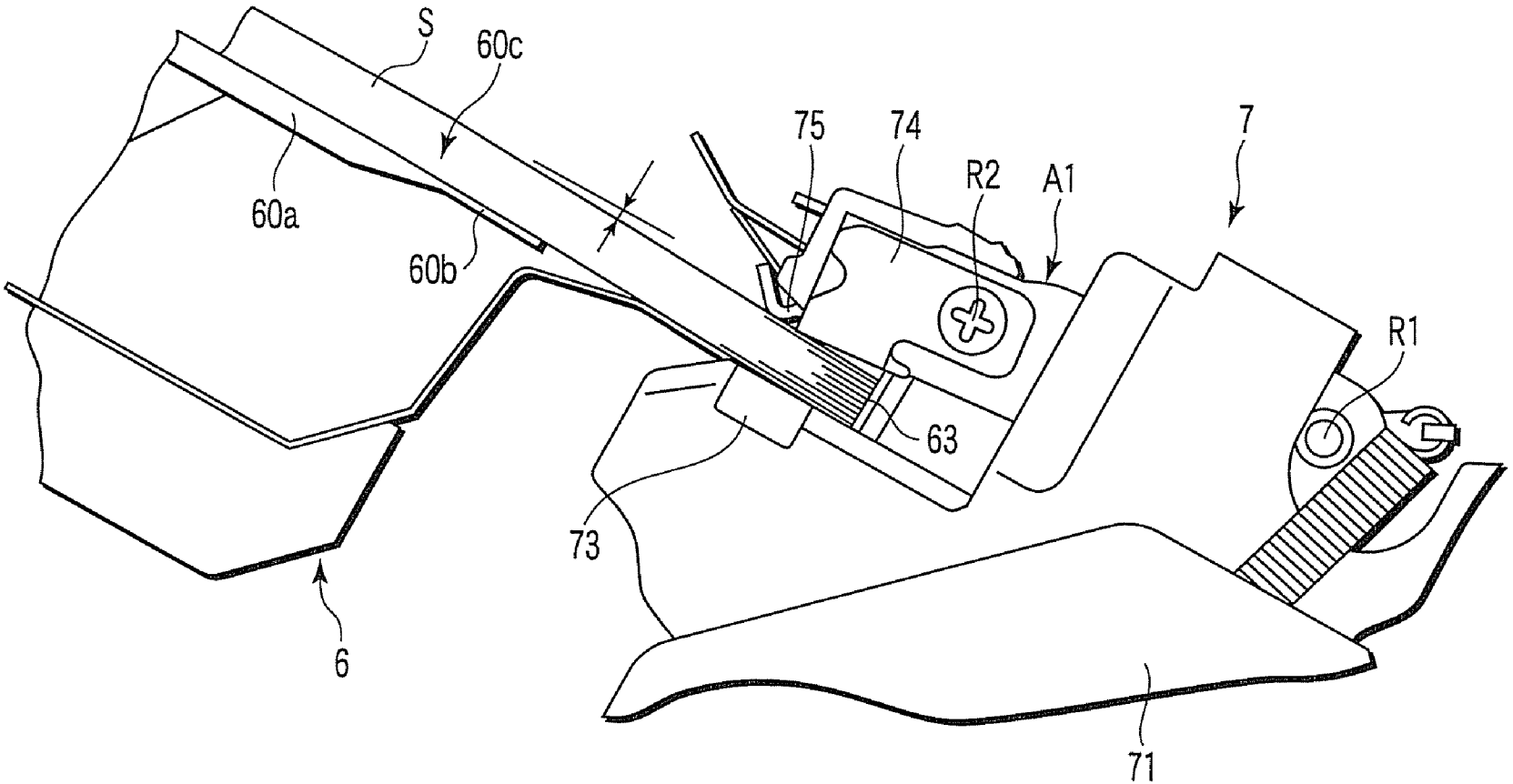
FIG. 4 is a sectional view showing the state that the stapler of FIG. 3 clamps a sheaf of sheets.

As shown in FIG. 3, the fixed part 73 is provided at the position deviated from the top of the mounting area 60*a* to the mounting area 60*a* side in the thickness direction of the sheaf of sheets S, by the extent indicated by C in the drawing, and closer to the mounting area 60*a* than the edge holding part 63 in the direction of ejecting the sheaf of sheets S. The arm 74 is rotationally moved from a clamping position A1 to an opening position A2. The clamping position A1 is the position that the arm 74 holds down the sheaf of sheets S toward the fixed part 73, as shown in FIG. 4. The opening position A2 is the position that the arm 74 is rotationally moved toward the thickness of the sheaf of sheets S in the direction of separating from the fixed part 73, by the extent that the edge holding part 63 passes between the fixed part 73 and arm 74.

A number of staples of the stapler 7 are contained in the fixed part 73, and shot to pierce the sheaf of sheets S when the arm 74 is moved to the clamping position A1. The anvil 75 receives the point of the pierced staple. The anvil 75 is supported at the end of the arm 74, just like swinging around the axis R2 that is parallel to the rotation axis R1 of the arm 74. By this swinging, the anvil can receive the point of a staple at an appropriate angle, even if the thickness of the sheaf of sheets S differs.

The fixed part 73 is provided deviated from the mounting area 60*a* in the thickness direction of the sheaf of sheets, generating a clearance for the sheaf of sheets S inserted into the edge holding part 63. Therefore, the first sheet S of the sheaf of sheets S is not caught by the fixed part 73 while moving into the edge holding part 63. The fixed part 73 is preferably inclined a little to meet the angle of the sheaf of sheets S to be bent by being held down by the arm 74.

When the arm 74 is rotationally moved to the clamping position in this state, the edge of the sheaf of sheets S is pressed to the fixed part 73. Therefore, the sheaf of sheets S is bent in the thickness direction to the mounting area 60*a*. At this time, as shown in FIG. 4, as the flexible portion 60*b* is provided integrally with the edge of the mounting area 60*a*, the flexible portion 60*b* is bent to follow the bending of the sheaf of sheets S.

Since the processing tray 6 has the flexible portion 60*b*, the distance from the bent part of the sheaf of sheets S to the stapling position can be increased. As a result, the displacement of sheet is decreased at the stapling position. Therefore, the sheet post-processing apparatus 1 can staple the sheaf of sheets S with the edges of sheets neatly aligned. The sheet P is rarely displaced during stapling, preventing a stapling error caused by a staple being bent during stapling.

The controller 8 obtains information about stapling input from the operation panel of MFP 100, through an interface, and determines the position of the head 71 of the stapler 7 along the positioning rail 72, based on this information. The paper eject trays 9*a* and 9*b* hold a stack of layered sheets S stapled in the processing tray 6, a sheaf of sheets S stacked only, or a sheet P ejected through the standby tray 5 in the case that a processing is unnecessary in the processing tray.

Figure 12:
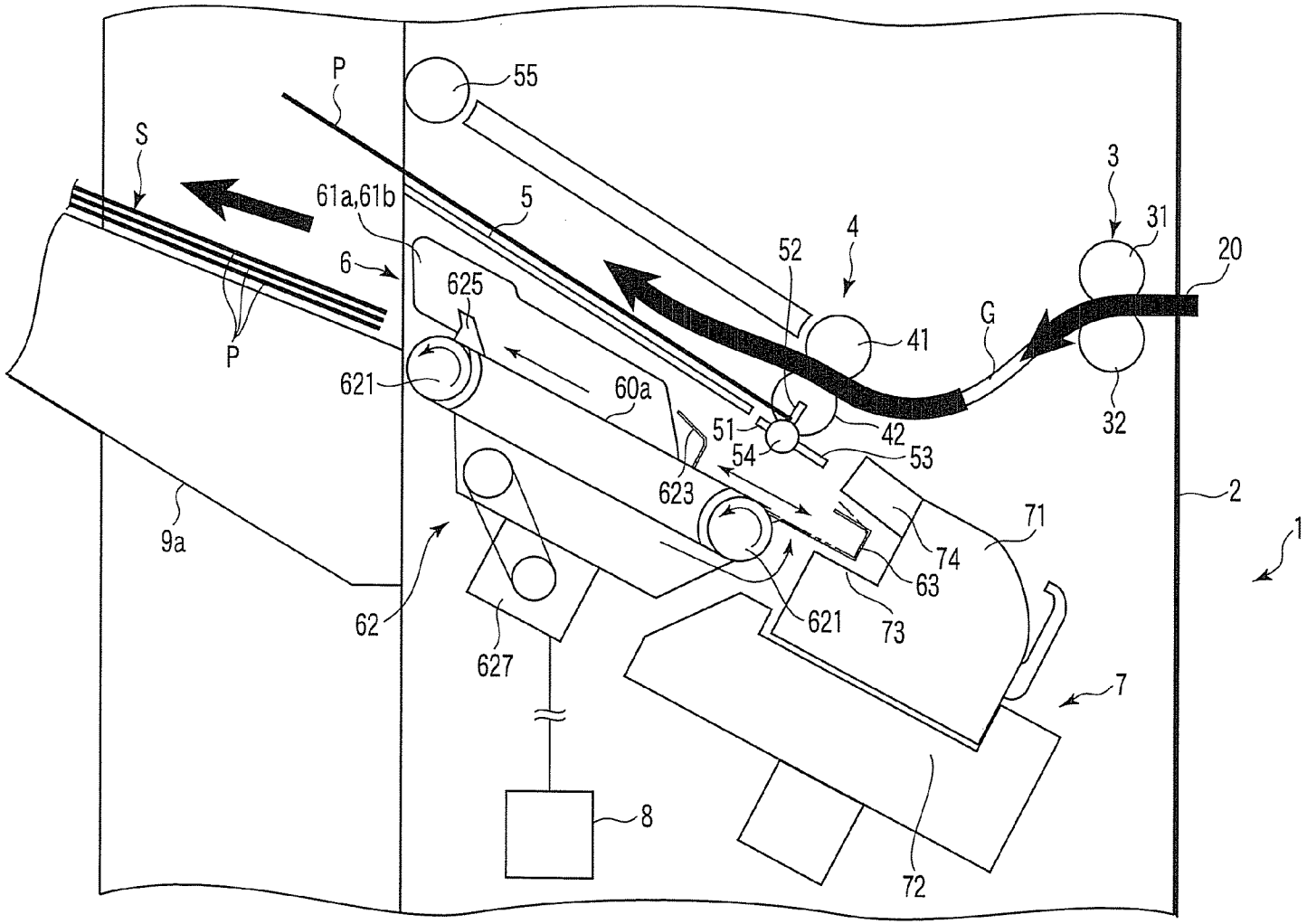
FIG. 12 is a schematic diagram showing the state that the sheet post-processing apparatus of FIG. 11 pushes a stapled sheaf of sheets out to a paper eject tray, and takes a second sheet into a standby tray.

The sheet post-processing apparatus 1 configured as described above binds and staples a sheet P ejected from the MFP, and ejects it to the paper eject tray with serial operation shown from FIG. 5 in FIG. 12.

Figure 6:
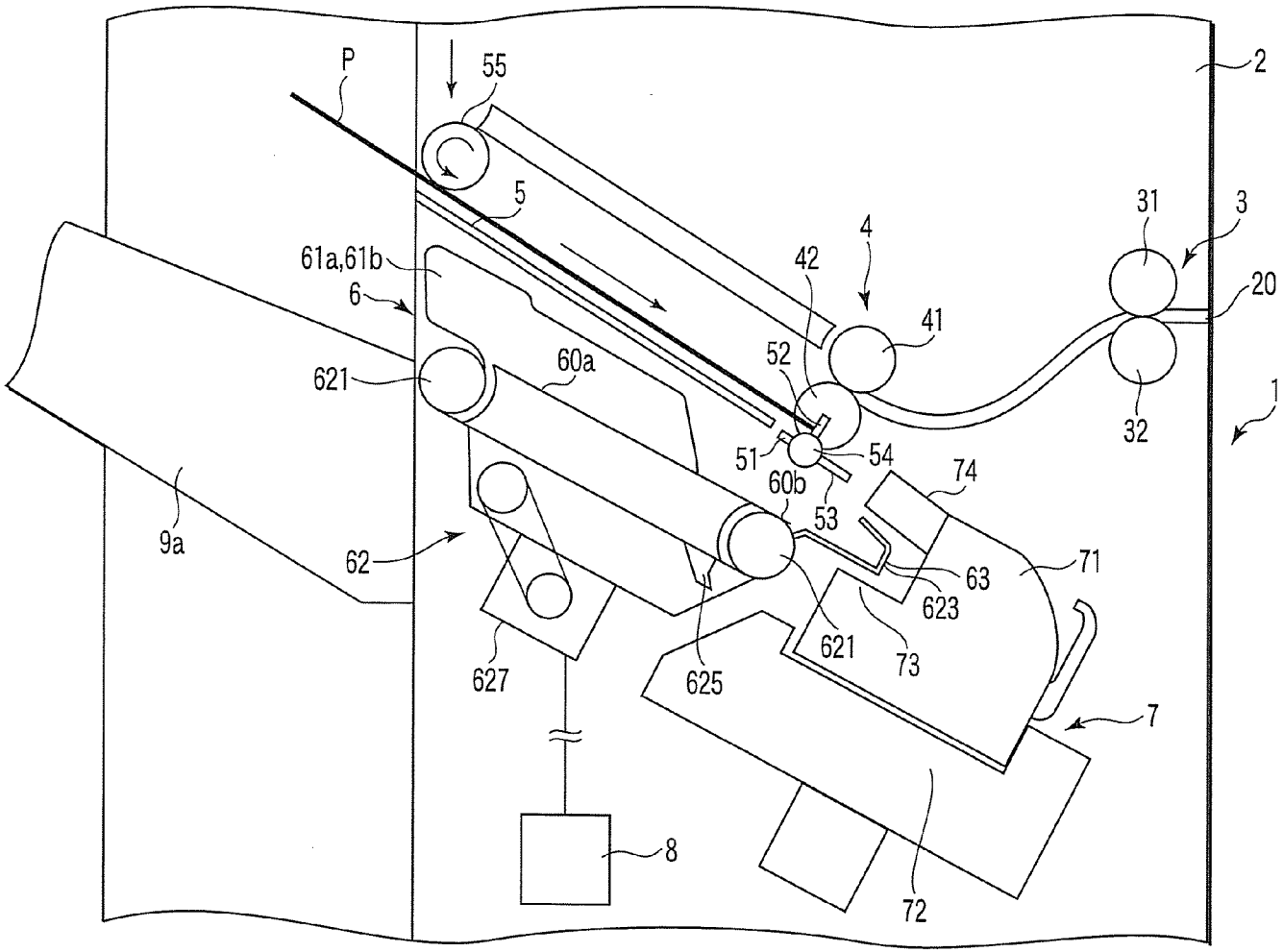
FIG. 6 is a schematic diagram showing the state that the sheet post-processing apparatus of FIG. 5 positions a first sheet on a standby tray.
Figure 7:
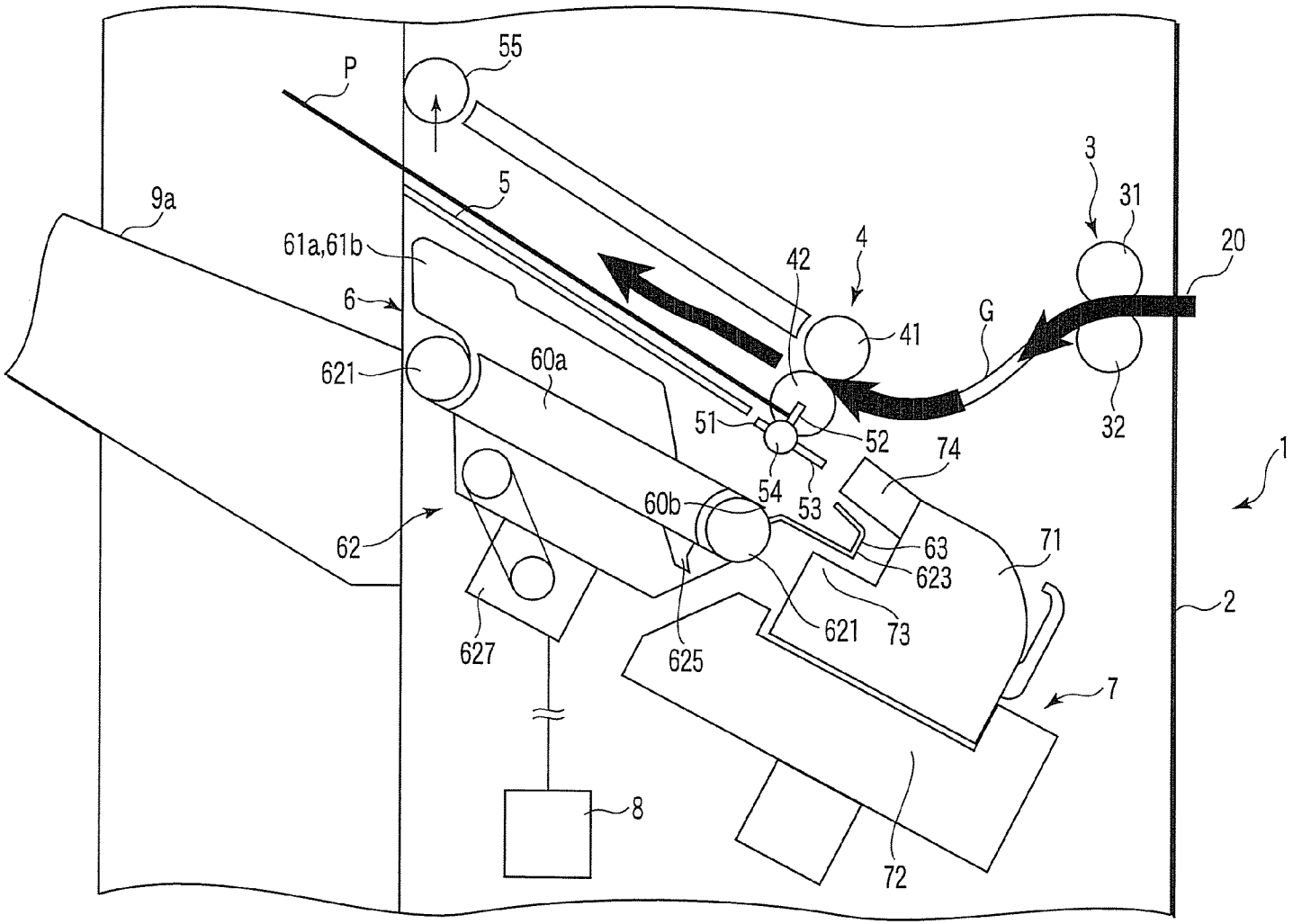
FIG. 7 is a schematic diagram showing the state that the sheet post-processing apparatus of FIG. 6 takes a second sheet of a sheaf of sheets into a standby tray.
Figure 8:
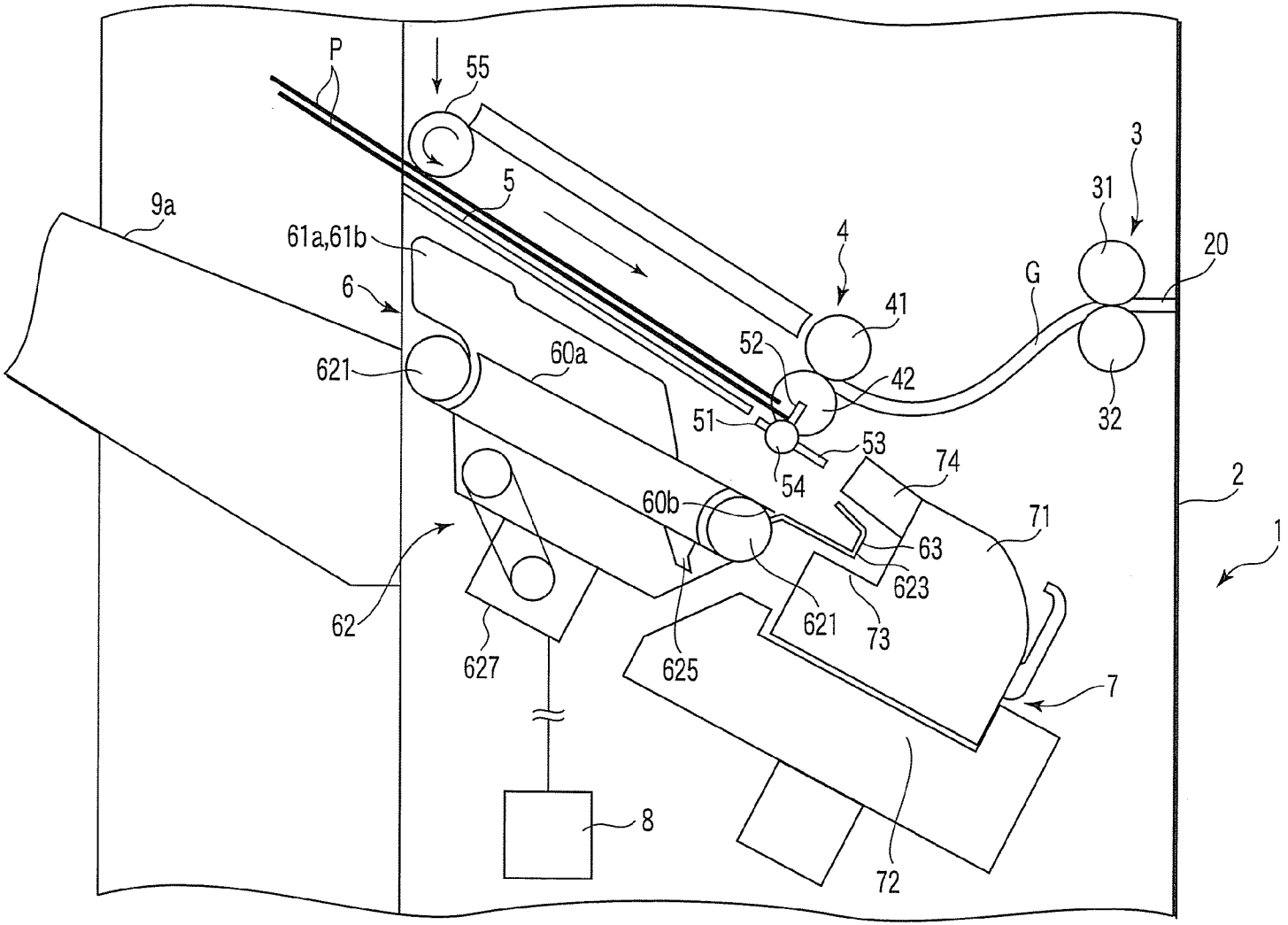
FIG. 8 is a schematic diagram showing the state that the sheet post-processing apparatus of FIG. 7 positions a second sheet on a standby tray.

When stapling is selected by the operation panel of MFP 100, the sheet post-processing apparatus 1 takes in a first sheet P of a sheaf of sheets S through the take-in port 20, and guides it to the standby tray 5, as shown in FIG. 5. The first sheet P guided to the standby tray 5 is applied to the tap fin 52 by the rotation of the standby tray roller 55 moved down, as shown in FIG. 6. A second sheet P is also taken in the standby tray as shown in FIG. 7, and applied to the tap fin 52 by the standby tray roller 55 as shown in FIG. 8.

When the second sheet P is moved to the rotor 54, the standby tray 5 is broadened in the width direction. Thus, the first and second sheets P are dropped into the processing tray 6. At this time, as the rotor 54 rotates and the tap fin 52 sweeps down the edge of the sheet P, the sheet P is securely dropped into the processing tray 6. The rotor 54 rotates further as shown in FIG. 9, and the paddle 53 scrapes and feeds the uppermost sheet P among the sheets P dropped onto the processing tray 6, and applies it to the edge holding part 63 and sheaf send-out claw 623.

The conveying roller 621 of the processing tray 6 rotates in the direction of applying the sheet P to the edge holding part 63 and sheaf send-out claw 623, as indicated by the arrow in FIG. 9. Thus, the lowermost sheet P among the dropped sheets P is applied to the edge holding part 63 and sheaf send-out claw 623. Almost simultaneously with this operation, the width adjustment pads 61*a* and 61*b* are operated to adjust the sheet P in the width direction.

Figure 10:
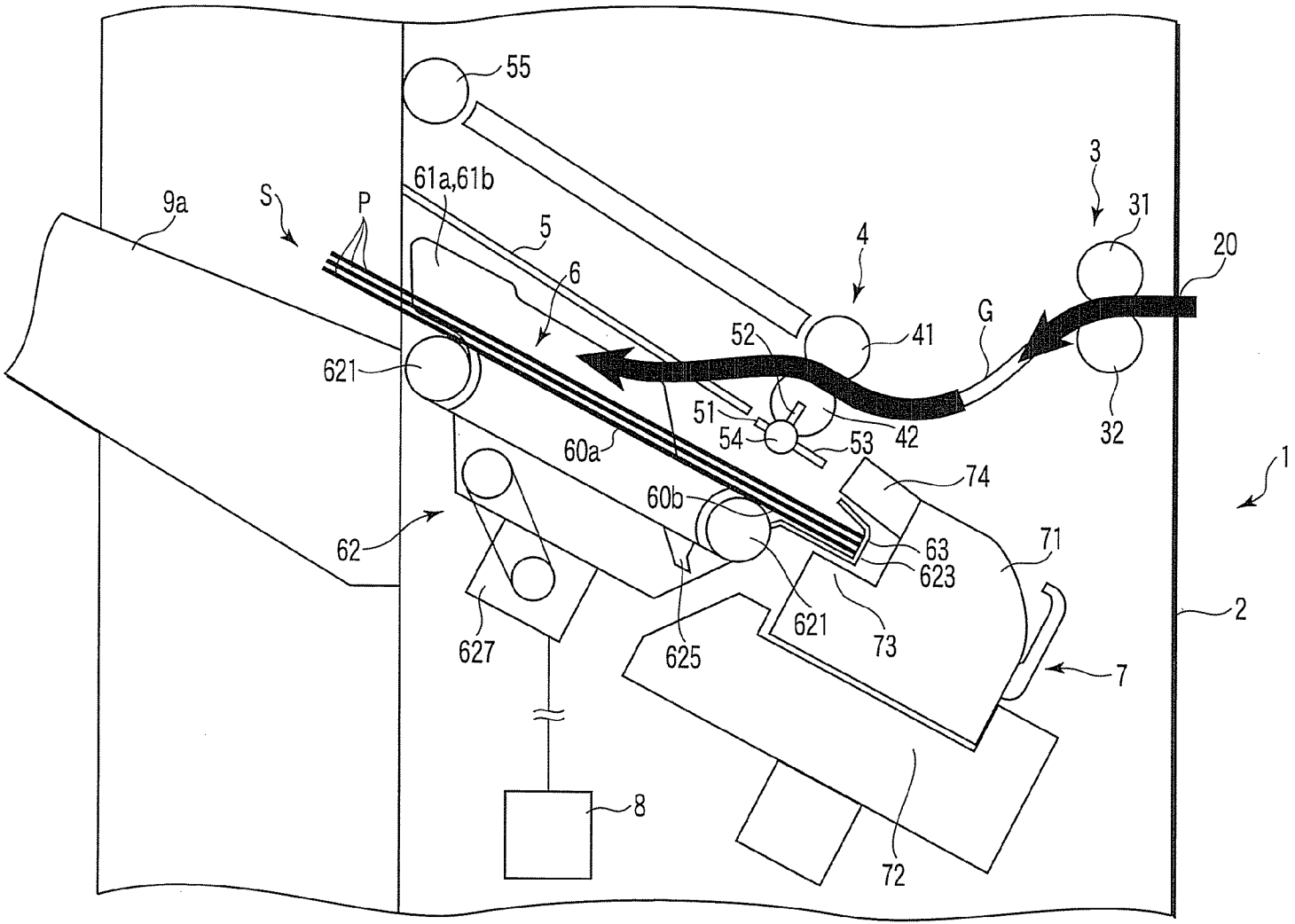
FIG. 10 is a schematic diagram showing the state that the sheet post-processing apparatus of FIG. 9 takes a third and following sheets of a sheaf of sheets into a standby tray.

The third and following sheets P of the sheaf of sheets S pass through the standby tray 5 broadened both sides in the width direction, as shown in FIG. 10, and are directly taken into the processing tray 6. The third and following sheets P stacked on the processing tray 6 are scraped to the edge holding part 63 and sheaf send-out claw 623 by the paddle 53 of the rotor 54, whenever they are stacked. The edge of the sheaf of sheets S of the stapler 7 is aligned by this operation. The width adjustment pads 61*a* and 61*b* are also operated, preventing a displacement of the sheet P in the width direction.

Figure 11:
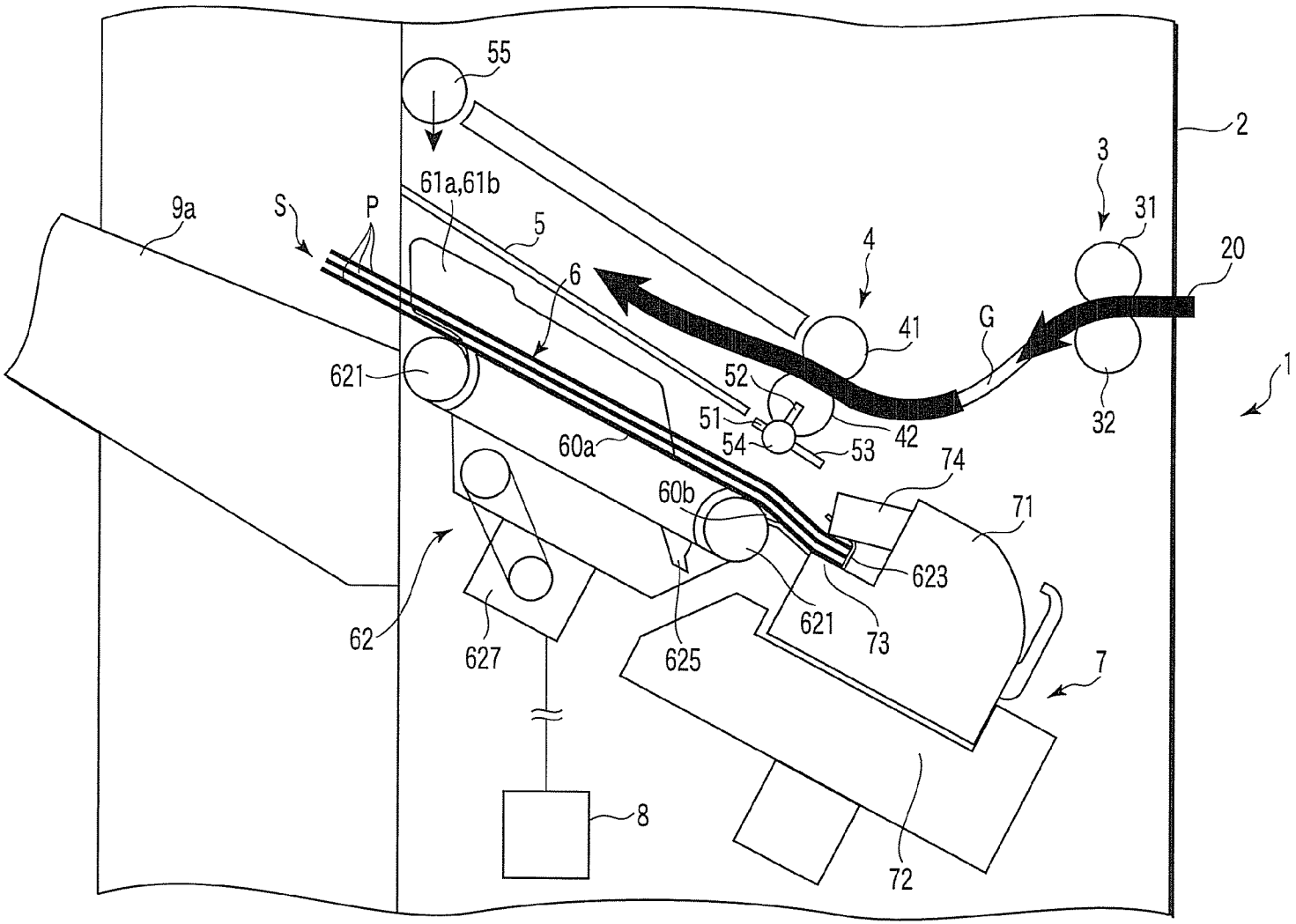
FIG. 11 is a schematic diagram showing the state that the sheet post-processing apparatus of FIG. 10 staples a sheaf of sheets stacked on a processing tray, and takes a first sheet of a next sheaf of sheets into a standby tray.

When sheets P for one sheaf have been stacked, the sheaf of sheets S is stapled and bound into one sheaf by the stapler 7 as shown in FIG. 11. Since the flexible portion 60*b* is provided at the edge of the mounting area 60*a* of the processing tray 6, the whole sheaf of sheets S is bent from the zone around the boundary 60*c* between the mounting area 60*a* and flexible portion 60*b*. Therefore, a sheet of the sheaf of sheets S is prevented from being partially displaced. This effect is particularly extreme when the sheaf is stapled at two or more positions.

After the last sheet P of the sheaf of sheets S passes through the standby tray 5, and before the first sheet P of the next sheaf of sheets is sent to the standby tray 5, the standby tray 5 broadened in the width direction is closed to the width capable of receiving the sheet P. The first sheet P of the next sheaf of sheets S taken in after the last sheet P of the stapled sheaf of sheets S, is taken in the standby tray 5 which is closed.

The stapled sheaf of sheets S is pushed to the paper ejecting tray 9*a* by the sheaf send-out claw 623 and sheaf conveying claw 625, as shown in FIG. 12. The controller 8 synchronizes the rotation speed of the conveying roller 621 with the moving speed of the sheaf send-out claw 623 and sheaf conveying claw 625. Thus, the sheaf of sheets S is pushed out to the paper ejecting tray 9*a* in the state bound into a sheaf. All sheets P taken in from the MFP 100 during this period are stacked on the standby tray 5.

In this embodiment, the operations of stapling and conveying the sheaf of sheets S to the paper ejecting tray 9*a* are finished while two sheets P are taken in. Therefore, the third and following sheets P are processed through the same procedures as those shown in FIG. 9 to FIG. 12. In the case that much time is required to eject the stapled sheaf of sheets S, such as, when stapling at two or more positions is specified, the sheet post-processing apparatus 1 temporarily stacks a sheet P on the standby tray 5, even if the sheet P is a third or a subsequent sheet, while a preceding sheaf of sheets S is ejected from the processing tray 6.

The width adjustment pads 61*a* and 61*b* and rotor 54 which operate whenever the sheet P is taken in the processing tray 6, the standby tray 5 which is broadened whenever the sheaf of sheets S is ejected and closed when the last sheet P of the sheaf of sheets S passes, and the standby tray roller 55 which is moved down whenever the sheet P is stacked on the standby tray 5 and rotated in the direction of sending the sheet P to the rotor 54, are difficult to synchronize with the actual movement of the actual sheet P only by the signal from the MFP 100. Therefore, it is preferable to control the operation timing of the width adjustment pads 61*a* and 61*b*, rotor 54, and standby tray roller 55, depending on the output of the sensor or detection switch provided separately in the sheet post-processing apparatus 1.

The controller 8 of the sheet post-processing apparatus 1 guides the sheet P ejected from the MFP 100 to the standby tray 5, as shown in FIG. 13, when receiving an instruction signal requiring no post-processing from the MFP 100. The guided sheet P is sent out to the paper ejecting trays 9*a* and 9*b* through the standby tray roller 55. In this case, the paper ejecting trays 9*a* and 9*b* are moved to a height suitable for receiving the sheet P sent from the standby tray 5.

In this embodiment, the flexible portion 60*b* is formed thicker than the mounting area 60*a*, and is more flexible than the mounting area 60*a*. The flexible portion 60*b* is merely required to have flexibility in the direction opposite to the side of stacking the sheaf of sheets S rather than the mounting surface, when the edge of the sheaf of sheets S is held down to the fixed part 73 by the arm 74 of the stapler 7. Therefore, the flexible portion 60*b* may have a cross section that decreases the downward flexural rigidity, other than being made thinner than the mounting area 60*a*. For example, the flexible part may be formed by cutting the edge of the mounting area 60*a* like a comb. However, when stapling at two or more positions of one sheaf of sheets S, the edge of the sheaf of sheets S is preferably bent evenly in the width direction, not to displace the sheet P of the sheaf of sheets S between adjacent staples.

According to the sheet post-processing apparatus of the invention, when a sheaf of sheets is clamped to the fixed part by the arm for stapling, the flexible portion formed integrally with the stapler of the mounting area is bent. Therefore, a sheaf of sheets is gently bent, and a sheet is difficult to be displaced during stapling. As a result, it is easy to pierce straight a sheaf of sheets with a staple of the stapler. Namely, the occurrence of defective stapling is decreased.

Moreover, as the flexible portion is formed integrally with the mounting area and at the same level as the top of the mounting area, even if a first sheet warps a little, the sheet can be stacked without causing a jam. Further, the flexible portion and mounting area are formed as one unit, and the cost of providing a flexible portion formed by a different member is decreased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet post-processing apparatus comprising:

a processing tray on which a sheaf of sheets is made, the processing tray further comprising;

a mounting area on which a sheet to be stapled is stacked;

a flexible portion which is formed integrally with the mounting area and at the same level as the upper surface of the mounting area, along the edge of the mounting area of the side to staple the sheaf of sheets, and is bent easier than the mounting area in the direction of the thickness of the sheaf of sheets toward the mounting area; and an edge holding part which extends to the stapler further than the flexible portion, and supports the edge of a sheet stacked on the mounting area; and a stapler which staples the sheaf of sheets, the stapler further comprising:

a fixed part which is provided at a position deviated from the upper surface of the mounting area to an opposite side of the mounting area, and closer to the mounting area than the edge holding part; and an arm which is provided at a position to hold the edge of the sheaf of sheets toward the fixed part, and is rotationally moved in the direction of stacking the sheaf of sheets, wherein the flexible portion is made thinner than the mounting area in the direction of stacking the sheaf of sheets.

2. The sheet post-processing apparatus according to claim 1, wherein the stapler further has a head which supports the fixed part and arm, and a positioning rail which moves the head along the edge of a sheaf of sheets stacked on the processing tray and projected from the flexible part.

3. The sheet post-processing apparatus according to claim 1, further comprising:

a standby tray which is arranged over the processing tray to temporarily stack a sheet taken in while the sheaf of sheets to be processed first remains in the processing tray.

4. A sheet post-processing apparatus comprising:

a processing tray on which a sheaf of sheets is made, the processing tray further comprising:

a mounting area on which a sheet to be stapled is stacked;

a flexible portion which is formed integrally with the mounting area and at the same level as the upper surface of the mounting area, along the edge of the mounting area of the side to staple the sheaf of sheets, and is bent easier than the mounting area in the direction of the thickness of the sheaf of sheets toward the mounting area; and an edge holding part which extends to the stapler further than the flexible portion, and supports the edge of a sheet stacked on the mounting area;

a stapler which staples the sheaf of sheets, the stapler further comprising:

a fixed part which is provided at a position deviated from the upper surface of the mounting area to an opposite side of the mounting area, and closer to the mounting area than the edge holding part; and an arm which is provided at a position to hold the edge of the sheaf of sheets toward the fixed part, and is rotationally moved in the direction of stacking the sheaf of sheets;

a standby tray which arranged over the processing tray to stack a sheet taken in while the sheaf of sheets to be processed first remains in the processing tray; and a rotor which is provided at the end of the standby tray close to the stapler side and has a paddle to send the uppermost sheet of the sheaf dropped onto the processing tray.

5. The sheet post-processing apparatus according to claim 4, wherein the standby tray has a left-side receiver and a right-side receiver which are separated to both sides in the width direction of the supplied sheet.

6. A sheet post-processing method comprising:

making a sheaf of sheets stacking on a processing tray, said processing tray having a mounting area and a flexible portion, said flexible portion being formed integrally with the mounting area and at the same level as the upper surface of the mounting area, along the edge of the mounting area of a side to staple the sheaf of sheets;

stacking a sheet on a standby tray which is arranged over the processing tray taken in while the sheaf of sheets to be processed first remains in the processing tray;

sending the uppermost sheet of the sheaf of the sheets drooped onto the processing tray by rotating a rotor which is provided at the end of the standby tray close to the stapler side and has a paddle; and stapling the sheaf of sheets stacked on the processing tray, by using a stapler which has a fixed part and an arm, said fixed part provided at a position deviated from the upper surface of the mounting area to an opposite side of the mounting area.

* * * * *